US006334032B1

(12) United States Patent
Tomiki

(10) Patent No.: US 6,334,032 B1
(45) Date of Patent: Dec. 25, 2001

(54) IMAGE FORMING APPARATUS HAVING A SEPARATING AND CHARGE ELIMINATING DEVICE FOR CHARGE ELIMINATING A RECORDING MATERIAL FROM THE PHOTOSENSITIVE DRUM

(75) Inventor: Satoshi Tomiki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/449,971

(22) Filed: Nov. 26, 1999

(30) Foreign Application Priority Data

Dec. 3, 1998 (JP) ..... 10-344221

(51) Int. Cl.[7] ..... G03G 15/16
(52) U.S. Cl. ..... 399/66; 399/315
(58) Field of Search ..... 399/66, 313–315

(56) References Cited

U.S. PATENT DOCUMENTS

| | | | | |
|---|---|---|---|---|
| 5,182,604 | | 1/1993 | Asai . | |
| 5,633,703 | * | 5/1997 | Takenouchi et al. | 399/315 |
| 5,689,771 | * | 11/1997 | Sato et al. | 399/101 |
| 5,697,015 | | 12/1997 | Ream et al. | 399/66 |
| 5,713,063 | * | 1/1998 | Oono | 399/66 |
| 5,722,010 | * | 2/1998 | Okubo et al. | 399/66 |

FOREIGN PATENT DOCUMENTS

| | | |
|---|---|---|
| 0 391 306 | 10/1990 | (EP) . |
| 58-122561 | 7/1983 | (JP) . |
| 61-188570 | 8/1986 | (JP) . |
| 2-123385 | 5/1990 | (JP) . |
| 10-97147 | 4/1998 | (JP) . |

OTHER PUBLICATIONS

European Search Report.

* cited by examiner

*Primary Examiner*—William J. Royer
(74) *Attorney, Agent, or Firm*—Fitzpatrick, Cella, Harper & Scinto

(57) ABSTRACT

The present invention relates to an image forming apparatus which includes an image bearing member for bearing a toner image, transfer device for electrostatically transferring the toner image on the image bearing member to a transfer material, separating and charge eliminating device for charge-eliminating the transfer material to separate the transfer material from the image bearing member, wherein the transfer device includes a transfer member forming a nip with the image bearing member and constant current control device for controlling a current to be applied on the transfer member to a predetermined value, and wherein the constant current control device effects control at a first current value from before a leading end of the transfer material reaches the nip, and switches to a second current value larger than the first current value in the vicinity of a trailing end of the transfer material in transferring operation.

4 Claims, 7 Drawing Sheets

IMAGE FORMING APPARATUS HAVING A SEPARATING AND CHARGE ELIMINATING DEVICE FOR CHARGE ELIMINATING A RECORDING MATERIAL FROM THE PHOTOSENSITIVE DRUM

BACKGROUND OF THE INVENTION

1. Field of the Invention

This invention relates to an image forming apparatus such as a copying machine or a printer using the electrophotographic method or the electrostatic recording method.

2. Related Background Art

FIG. 7 of the accompanying drawings shows a cross-sectional view of an image forming apparatus which is the background of the present invention.

The reference numeral 10 designates a photosensitive member, the reference numeral 13 denotes developing means, the reference numeral 16 designates transfer charging means, and the reference character 19*a* denotes a charge eliminating needle as a charge eliminating member.

An electrostatic image formed on the photosensitive member 10 is visualized into a toner image by the developing means 13. In order to transfer this toner image to a transfer material, use is made of transfer charging means for imparting charges (back charges) to the back of the transfer material in a transfer area, and electrostatically attracting the toner image to the transfer material.

In recent years, as transfer chargers, contact transfer chargers such as transfer rollers having such merits as the compactness of power source capacity and a small amount of production of discharge product typified by ozone, as compared with a well known corona charger or the like have spread, and such chargers of various materials, sizes and volume resistivities have been practically used.

The corona charging transfer method imparts back charges to the back of a transfer material by discharge into the air and therefore, the outputted current value generally need be about several mA, whereas in the contact transfer charging method, the outputted current can be suppressed by about a figure to about three figures, i.e., to about several $\mu$A to about several hundreds of $\mu$A. However, of such contact transfer means, a more accurate control method is required in order to make the charges directly imparted to the back of the transfer material as uniform as possible, and to adapt the charges to changes in the transfer condition and the environment.

So, there is also known a transfer voltage controlling method, called ATVC control, of constant-current-controlling the transfer charging means by a predetermined current value during the non-supply of sheets, and constant-voltage-controlling the transfer charging means by a voltage value determined on the basis of the voltage at this time during the supply of sheets, in order to apply a proper transfer voltage irrespective of the size of the transfer material, and the atmosphere and environment such as temperature and humidity (Japanese Patent Laid-Open Application No. 2-123385).

The transfer material after transfer is liable to twine around the photosensitive member 10 because it is charged by the transfer charging means 16, but the electrostatic attraction between the transfer material and the photosensitive member 10 is weakened by the charge eliminating needle 19*a* as the charge eliminating member as previously described, to thereby make the separation of the transfer material from the photosensitive member easy.

However, the transfer material passing above the charge eliminating needle is not always constant in its distance from the charge eliminating needle 19*a* over its entire area and therefore, even if in the transfer area, the back of the transfer material is uniformly charged, irregularity occurs to the amount of back charges residual on the back of the transfer material after the transfer material has passed above the charge eliminating needle 19*a*.

A little more specifically speaking, the leading end portion of the transfer material with respect to the direction of conveyance thereof (hereinafter the leading end and the trailing end will all be referred to as so with respect to the direction of conveyance) is conveyed with the rotation of the photosensitive member 10 while being attracted to the photosensitive member 10 by the electrostatic attraction, and the transfer material has its charges eliminated near the charge eliminating needle 19*a* and is separated from the photosensitive member and therefore, as indicated at 18*b* in FIG. 7 the transfer material passes a route somewhat near to the photosensitive member 10 by the time when it arrives at a conveying member 20 from the transfer area.

However, when a certain degree of range of the transfer material is separated, the transfer material is affected by the gravity of the leading end thereof and the rigidity (stiffness) of the transfer material itself and therefore, the trailing end thereof becomes liable to separate as compared with the leading end, and the transfer material tries to pass a route near to a portion 18*a* in FIG. 7.

Further, the charge eliminating needle 19*a* is usually constructed with a protective member 19*b* (or a guide member serving also to prevent contact) to prevent the transfer material from contacting the charge eliminating needle, and when that portion of the conveying member 20 which supports the transfer material and is nearest to the charge eliminating member 19*a* is constructed at a location higher than the upper end of the protective member 19*b*, the trailing end portion of the transfer material depends from the conveying member 20 by the gravity thereof after it has passed the transfer area, and becomes nearer to the charge eliminating needle 19*a*.

Usually the charge eliminating needle 19*a* is at ground potential or has applied thereto a voltage of the opposite polarity to the back charges and therefore, particularly when such a voltage is applied thereto, the nearer to the charge eliminating needle 19*a* is the transfer material, the more strongly affected by the electric field of the charge eliminating needle 19*a* is the transfer material, and more of the back charges are eliminated.

When, in such a case, the transfer charging means 16 uniformly imparts charges to the whole area of the transfer material, unevenness (irregularity) occurs to the back charges residual on the back of the transfer material after the elimination of the charges and particularly, the back charges near the trailing end portion become deficient. Thereupon, the electrostatic toner holding force of the transfer material becomes weak and the toner becomes liable to scatter or the electrostatic attraction between the trailing end portion of the transfer material and the conveying member weakens, and the disturbance or the like of the image by the abnormal behavior of the trailing end portion (hereinafter referred to as the trailing end jump) in a fixing portion becomes liable to occur.

On the other hand, when the transfer output is set to a rather high level from the leading end side in back charges become less and rather many charges are uniformly imparted to the transfer material, the back charges become excessive in the leading end portion to the central portion, and the charges go through the transfer material and negate the charging charges of the toner in the toner image. Particularly in the case of an image forming apparatus of the so-called reversal developing type in which the charging polarity of an image bearing member and the polarity of charges imparted by transfer charging means are opposite to each other, an excessive electric current flows between the transfer charging means 16 and the photosensitive member 10 immediately before the leading end portion of the transfer material comes to the transfer area, and that portion on the photosensitive member 10 through which the excessive electric current has flowed is not well charge-eliminated even if it is subjected to pre-exposure means 24. Therefore, a portion which cannot be sufficiently charged by a primary charger 11, i.e., a so-called charging memory, is created on the photosensitive member 10, and a poor image appears.

SUMMARY OF THE INVENTION

It is an object of the present invention to provide an image forming apparatus in which the scattering of a toner on the trailing end portion of a transfer material is prevented.

It is another object of the present invention to provide an image forming apparatus which does not create a transfer memory on an image bearing member.

It is still another object of the present invention to provide an image forming apparatus having:

an image bearing member bearing a toner image thereon;

transfer means for electrostatically transferring the toner image on the image bearing member to a transfer material;

separating and charge eliminating means for charge-eliminating the transfer material to separate the transfer material from the image bearing member; and switching (changeover) means for switching (changing over) the transfer intensity of the transfer means during the transferring operation.

The other object of the present invention will be apparent from the following explanation.

DESCRIPTION OF THE PREFERRED EMBODIMENTS

Some embodiments of the present invention will hereinafter be described with reference to the drawings.

Figure 1:
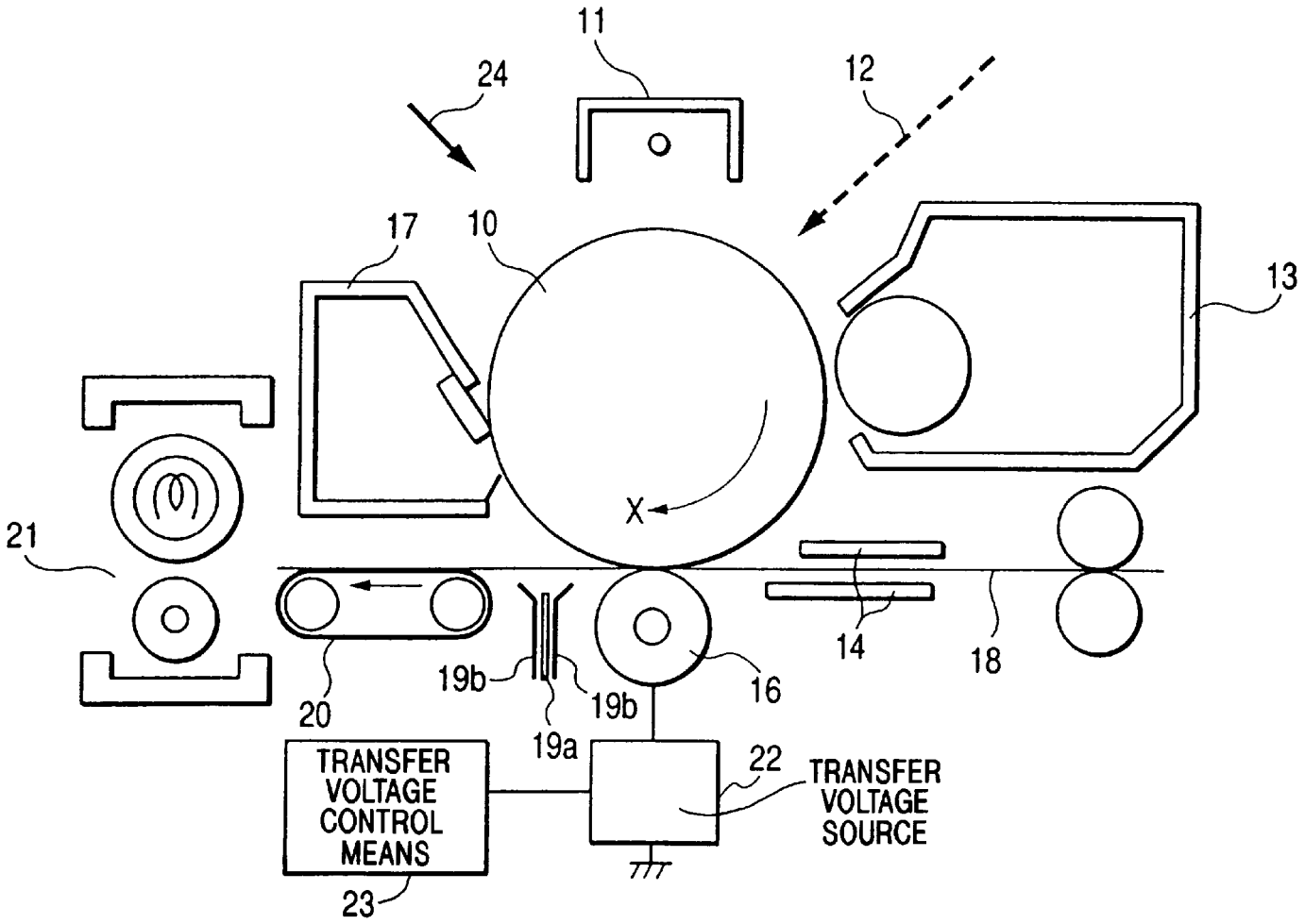
FIG. 1 is a cross-sectional view showing the basic apparatus construction of an image forming apparatus used in the present invention.

FIG. 1 is a cross-sectional view of an image forming apparatus which is an embodiment of the present invention.

Briefly describing the construction and action of the apparatus, the surface of a photosensitive member 10 having a diameter of 30 mm as an image bearing member rotated in the direction of arrow X is uniformly charged by a primary charger 11, and an image light 12 such as an image-modulated laser beam is imparted to the charged surface, whereby the potential of the portion is attenuated and an electrostatic image is formed.

Then, when the electrostatic image arrives at a developing region in which the photosensitive member 10 and developing means 13 are opposed to each other, a toner is supplied to the electrostatic image, whereby a toner image is formed.

Further, when by the rotation of the photosensitive member 10, the toner image is brought to a transfer area formed by a contact transfer charger (transfer roller) 16 and the photosensitive member 10 opposed to each other, a transfer material 18 is directed and conveyed by a transfer entrance guide 14 in timed relationship therewith, and by the action of a transfer electric field formed by the contact transfer charger 16 therewith, the toner image on the photosensitive member 10 is transferred to the transfer material 18.

Thereafter, the back charges on the back of the transfer material are eliminated by a charge eliminating needle 19*a* as a charge eliminating member, and the transfer material 18 is separated from the photosensitive member 10. Thereafter, the transfer material 18 is conveyed to a fixing device (a pair of fixing rollers) 21 while rubbing against the conveying surface of a conveying member 20, and the toner image is fixed on the transfer material 18. Also, any residual toner on the surface of the photosensitive member 10 is removed by a cleaner 17, whereafter the photosensitive member 10 repeats the steps of being subjected to pre-exposure means 24 to thereby reduce the surface potential thereof to nearly OV, and being again charged by the primary charger 11.

The charge eliminating needle 19*a* is constructed with a protective member (or a guide member serving also to prevent contact) 19*b* for preventing the transfer material 18 from contacting therewith, and that portion of the conveying member 20 which is nearest to the charge eliminating member 19*a* and supports the transfer material is constructed at a position higher than the upper end of the protective member 19*b* and therefore, the trailing end portion of the transfer material which has passed through the transfer area (hereinafter the leading end and the trailing end refer to the ends with respect to the direction of conveyance) is designed to depend from the conveying member 20, and the trailing end portion of the transfer material is more liable to approach the charge eliminating needle 19*a*. (In the present embodiment, the distance from the transfer area to the conveying member 20 is about 3 cm and the tip end of the charge eliminating needle 19*a* is located substantially at the middle between the two and 1 to 5 mm below the conveyance path of the transfer material 18.)

In FIG. 1, the reference numeral 22 designates a transfer voltage source, and the reference numeral 23 denotes transfer voltage control means (CPU), and a transfer current flowing through the contact transfer charger 16 is constant-current-controlled. The transfer voltage control means 23 is adapted to change over the output value of the constant current control at predetermined timing during the execution of transfer.

In the present embodiment, the charging polarity of the photosensitive member 10 and the charging polarity of the toner are minus and the polarity of the transfer voltage is plus, and the reversal developing method is used. The transfer material supply speed of the image forming apparatus according to the present embodiment is 210 mm/s.

A voltage of −2.3 kV is applied from a voltage source, not shown, to the charge eliminating needle 19*a*.

Figure 2:
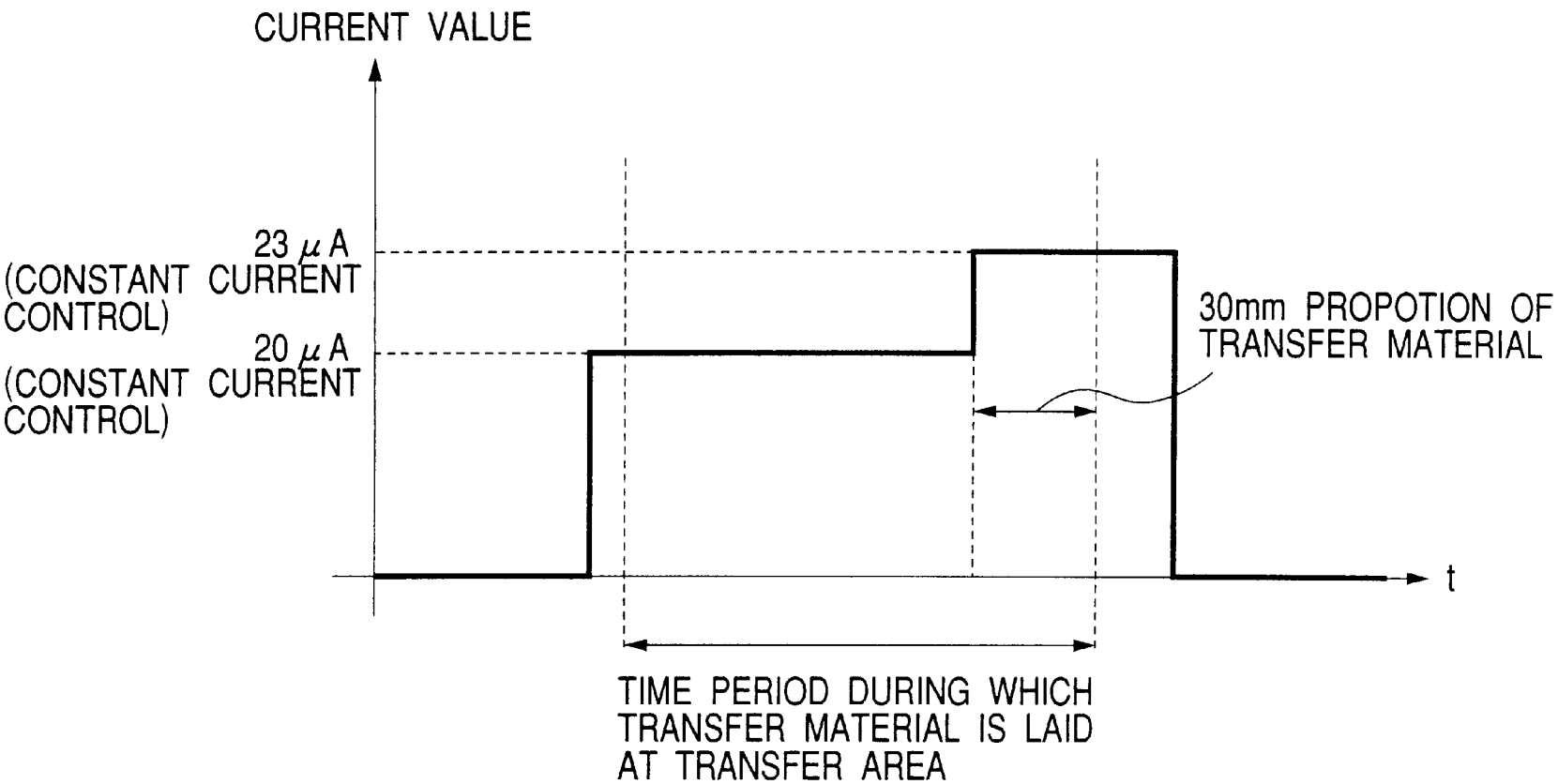
FIG. 2 shows the control of a transfer current in Embodiment 1 of the present invention.

FIG. 2 shows the control output value of the transfer current in the present embodiment.

In the present embodiment, the detection of the transfer material 18 is effected by a sensor, not shown, and at a location of about 30 mm short of the trailing end of the transfer material supplied to the image forming apparatus, the control output value of the contact transfer charger 16 is switched (changed over) from 20 $\mu$A to 23 $\mu$A to thereby strengthen the transfer intensity.

Figure 7:
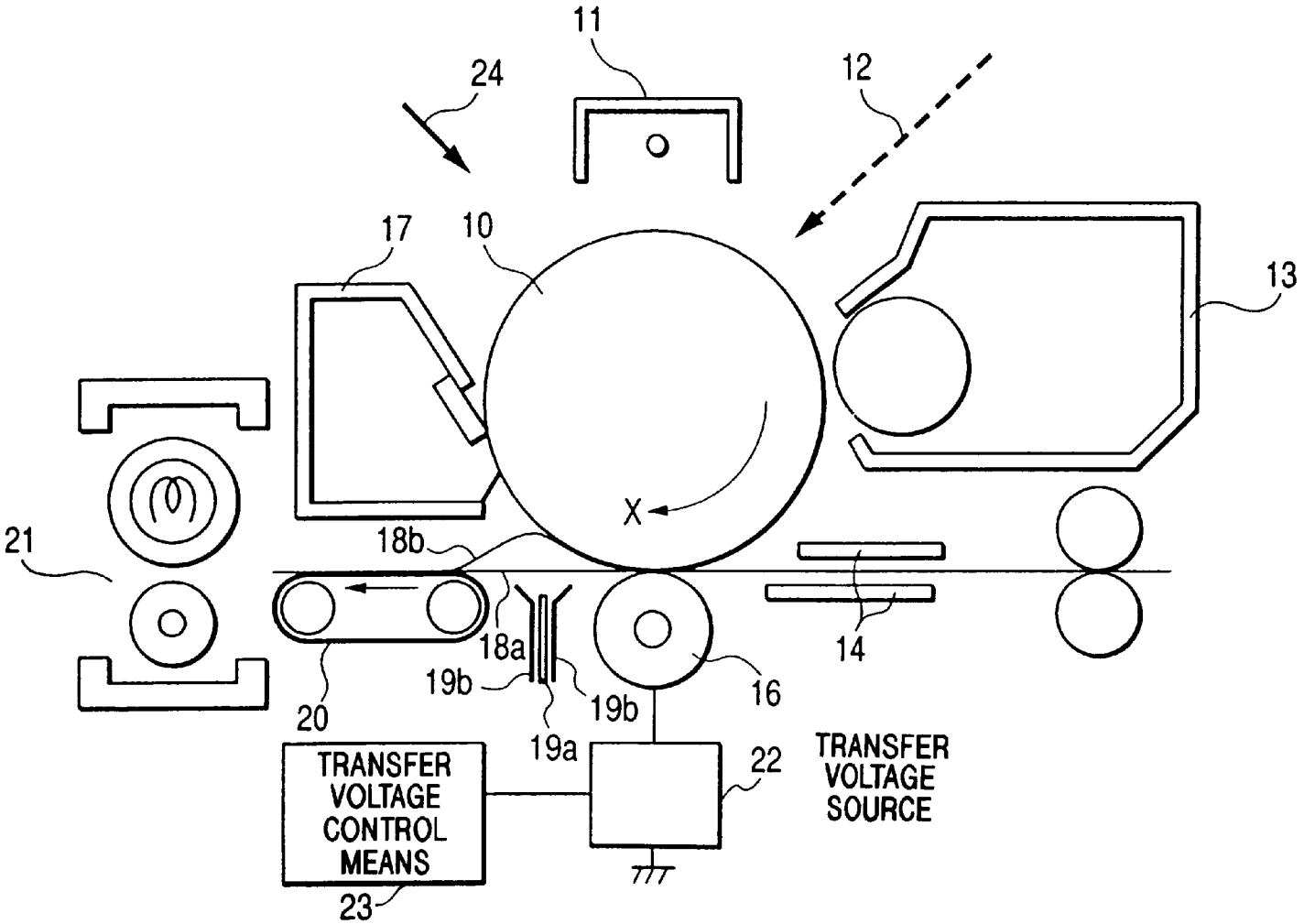
FIG. 7 is a cross-section of view of an image forming apparatus which is the background of the present invention.

Thereby, the amount of charge per unit area is imparted to the trailing end side beyond the output value changeover position becomes greater than that imparted to the leading end side and further, the electrostatic attraction between the transfer material 18 and the photosensitive member 10 becomes stronger and therefore, the trailing end side also passes along a route near 18*b* is FIG. 7, and the amount of the back charges near the trailing end portion of the transfer material flowing to the charge eliminating needle 19*a* can also be controlled. Consequently, sufficient back charges are also held on the trailing end portion of the transfer material, whereby the scattering of the toner near the fixing portion and during the conveyance of the transfer material can be prevented and the electrostatic attraction between the trailing end portion of the transfer material and the conveying member 20 strengthens and therefore, the distortion (disturbance) of the image by the jumping of the trailing end can also be prevented.

While the control output value changeover position in the present embodiment is a position of about 30 mm from the trailing end toward the leading end, of course this is not restrictive.

If for the prevention of the deficiency of the back charges due to the depending of the trailing end portion of the transfer material, depending on the positional relations among the charge eliminating needle 19*a*, the transfer material conveyance path, the photosensitive member 10, etc. or the quality and thickness of the transfer material, the control output value changeover position is set within the range of 0.5 cm to 5 cm, the deficiency of the back charges near the trailing end portion of the transfer material can be prevented.

It is particularly effective to set the changeover position at a location of the distance between the transfer area and the charge eliminating member from the trailing end portion toward the leading end side with respect to the direction of conveyance of the transfer material.

Figure 3:
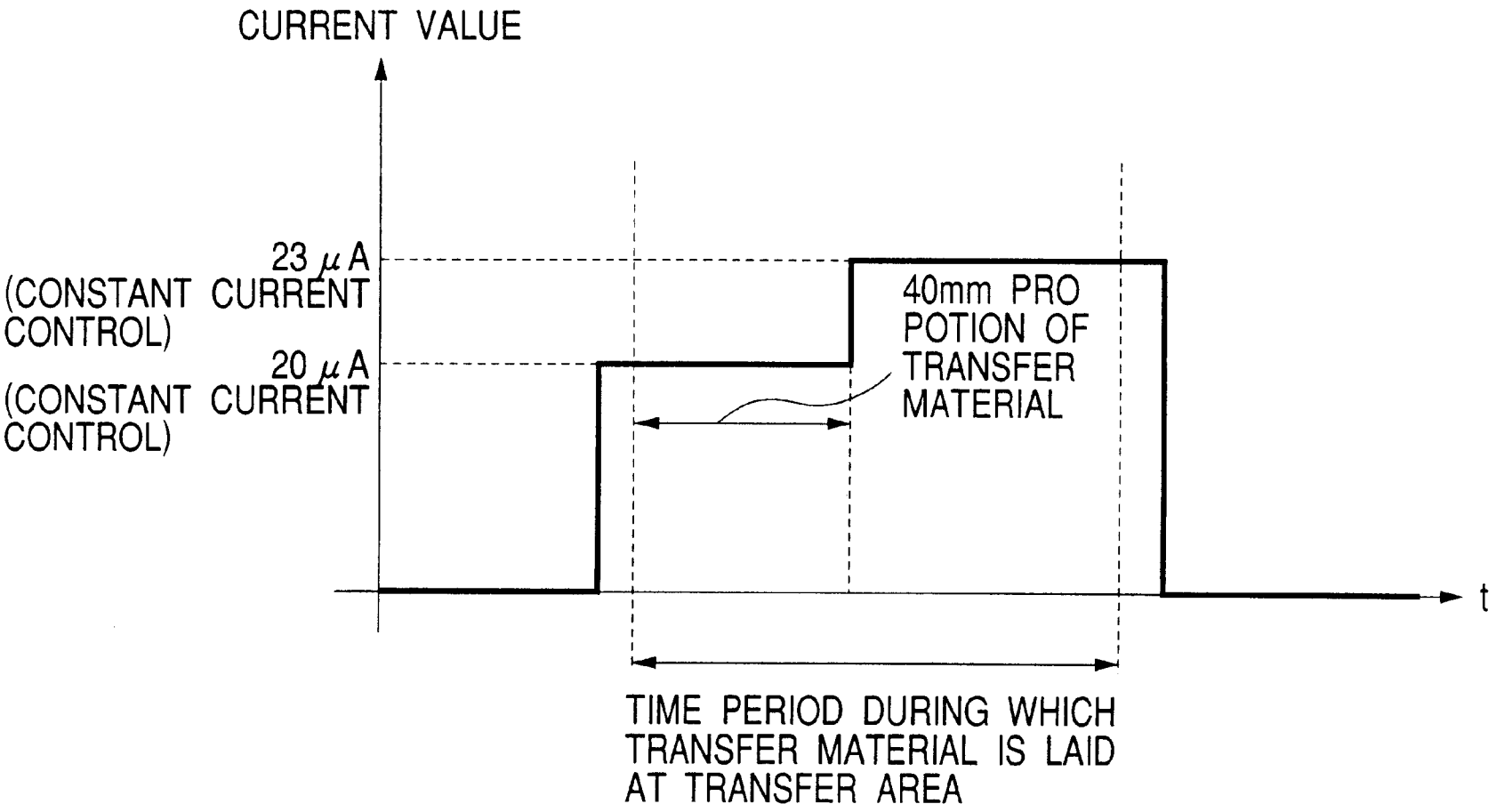
FIG. 3 shows another mode to which Embodiment 1 of the present invention is applied.

Further, when for the reason that the distance between the transfer area and the conveying member 20 is long, the deficiency of the back charges is seen even from a location near the leading end of the transfer material with respect to the direction of conveyance thereof and a charging memory is liable to occur, it is also possible to set the predetermined changeover position at a position near the leading end portion, and as shown, for example, in FIG. 3, it is also possible to change over the output value at a position of about 40 mm from the leading end toward the trailing end.

While in the embodiment of FIG. 1, the contact transfer charger has been described as a transfer roller, a transfer charger not in contact with the photosensitive member, such as a corona charger, can also be utilized.

Embodiment 2

Figure 4:
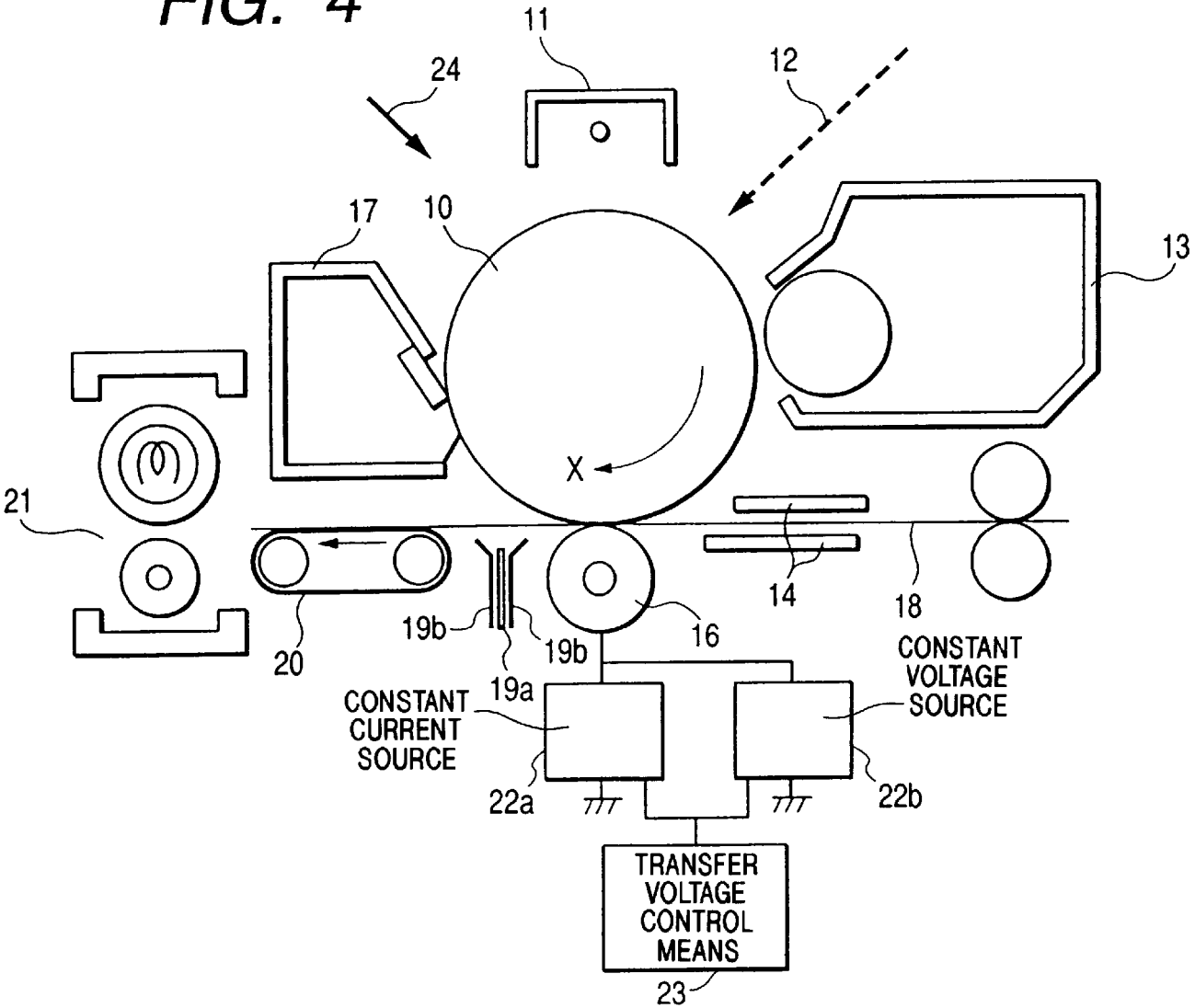
FIG. 4 is a cross-sectional view showing the basic apparatus construction of an image forming apparatus in Embodiment 2 of the present invention.

FIG. 4 is a typical view of an image forming apparatus which is another embodiment of the present invention, and in FIG. 4, the same reference numerals as those in FIG. 1 designate members similar to those in the aforedescribed apparatus, and need not be described. The reference character 22*a* designates a constant current power source, and the reference character 22*b* denotes a constant voltage source.

In this embodiment, from immediately before the leading end of the transfer material 18 comes to the transfer area, the contact transfer charger 16 is constant-current-controlled at 20 $\mu$A, and at changeover position for increasing the charges imparted to the transfer material, the constant current control is changed over to constant voltage control and the transfer charging means is constant-voltage-controlled by a voltage of a voltage value 5.2 kV determined by the aforementioned ATVC control so that the transfer current may substantially become the order of 30 $\mu$A.

For example, when the contact transfer charger 16 is a transfer roller if low t medium resistance which is a volume resistance value of $10^5$ to $10^9$ Ωcm, the impedance between the transfer roller and the photosensitive member 10 differs greatly depending on the presence or absence of the transfer material in the transfer area, and if in such a case, in an attempt to impart sufficient back charges to the back of the transfer material, the control output value of the transfer voltage is set to a rather great level to thereby effect constant voltage control, when a transfer voltage is applied from before the transfer material arrives at the transfer area, an excessive current flows before the leading end of the transfer material arrives at the transfer area, and the charging memory as previously described is liable to occur.

If, in contrast, constant current control is effected, the transfer voltage changes in conformity with the presence or absence of the transfer material in the transfer area and therefore, the aforementioned charging memory can be prevented.

So, in order to prevent the charging memory when a transfer roller of low to medium resistance is used as the transfer charging means 16, it may be said to be preferable to constant-current-control the transfer roller when the leading and trailing ends of the transfer material 18 pass through the transfer area.

Further, it is known that the volume resistance value of the transfer material in a low humidity environment becomes about $10^5$ to $10^6$ times as great as that in a high humidity environment, but during the supply of the transfer material, a leak current directly flowing from the contact transfer charger 16 to the charge eliminating needle through the transfer material increases with a change in the distance between the transfer material 18 and the charge eliminating needle and therefore, if constant current control is effected at this time, there arises the problem that particularly in the case of high humidity where the transfer material becomes low in resistance, the current for imparting transfer charges decreases greatly and accordingly, sufficient charges cannot be imparted.

Also, if the irregularity of the impedance of the transfer material itself is great even if the control output value is made great while constant current control remains effected, the electric current flows concentratedly through the portion of the transfer material through which the electric current is liable to flow, and this leads to a case where the amount of charges imparted to the transfer material does not increase in proportion to the increase in the control current value.

When the transfer current flowing to the transfer area changes as described above, charges can be more reliably imparted to the transfer material if constant voltage control is effected.

If the contact transfer charger is constant-voltage-controlled when the trailing end portion has passed through the transfer area with respect to the direction of conveyance of the transfer material, the charging memory may occur as previously described, but even if the charging memory occurs, the location at which the charging memory has occurred is exposed twice by the pre-exposure means 24 until the next transfer if the photosensitive member 10 makes one full rotation before the next transfer material is conveyed and therefore, the charging memory disappears and no problem in image formation will arise.

A described above, it is effective to effect constant current control on the leading end portion of the transfer material to thereby impart back charges thereto in order to prevent the charging memory, and further increase the amount of charges per unit area imparted to the transfer material by the contact transfer charger 16 and at the same time, effect the changeover from constant current control to constant voltage control in order to cope with the bad charging by a change in the above-mentioned leak current and the irregularity of the resistance of the transfer material itself.

Figure 5:
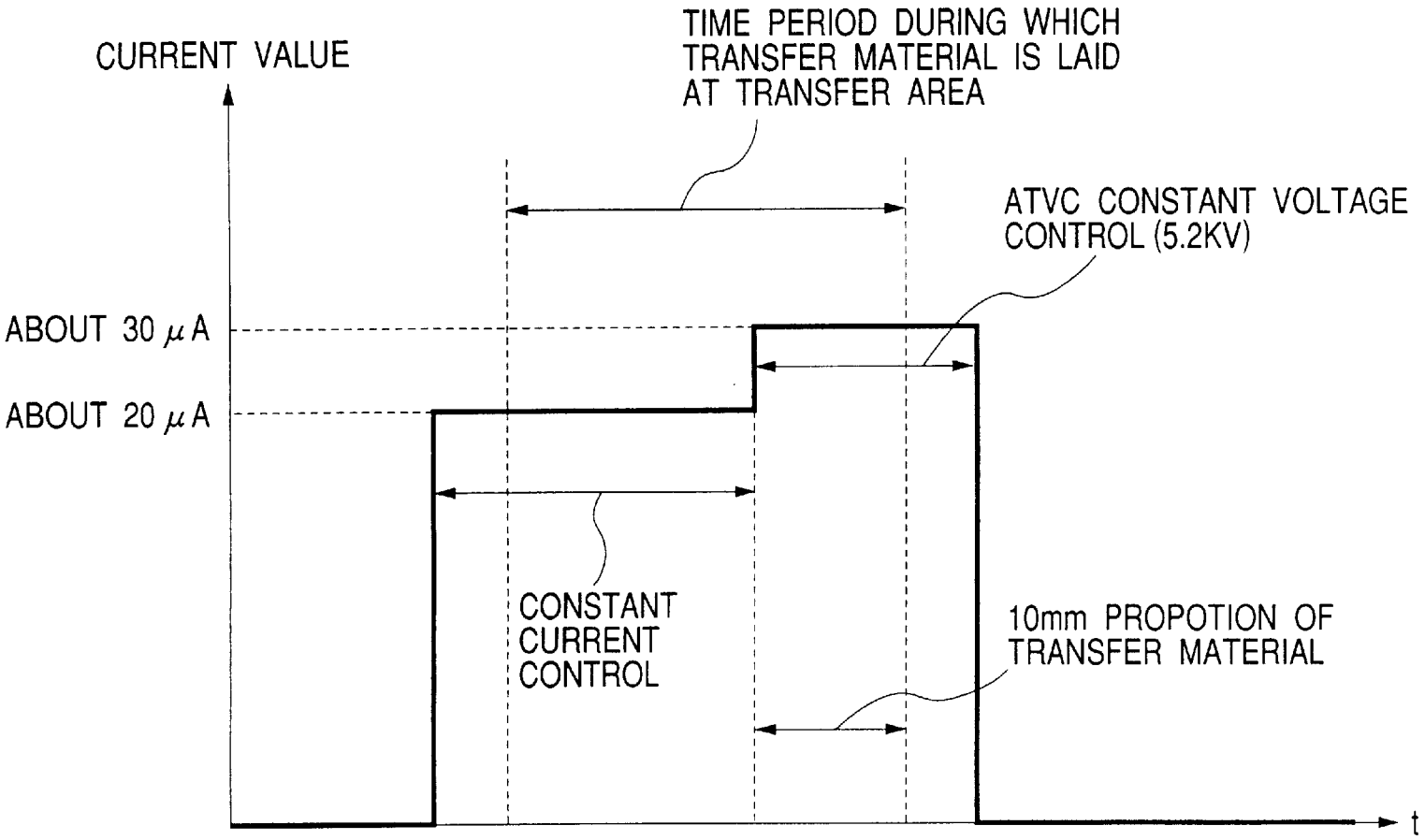
FIG. 5 shows the control of a transfer current in Embodiment 2 of the present invention.

FIG. 5 shows the control output value of the transfer current in the present embodiment.

In the present embodiment, the changeover point from constant current control to constant voltage control was effected at a position of 10 mm from the trailing end portion toward the leading end with respect to the direction of conveyance of the transfer material 18.

When during the constant current control of 20 $\mu$A, the amount of current of about 5 $\mu$A, flowing into the charge eliminating needle 19*a* directly or through the transfer material, is subtracted, it is charges corresponding to 15 $\mu$A that is actually imparted to the transfer material. Also, during constant voltage control, 5.2 kV is applied with an increase in the current flowing into the charge eliminating needle 19*a* by the transfer material 18 approaching the charge eliminating needle taken into account.

The current flowing into the charge eliminating needle 19*a* by constant voltage control is of the order of 15 $\mu$A, and the amount of charges imparted to the transfer material is of the order of 15 $\mu$A.

By the present embodiment, the instability by constant current control is null and the deficiency of charges held near the trailing end portion of the transfer material can be effectively prevented.

When a transfer material of a small size is used, the inflow of the transfer current to the non-sheet supply area in which the photosensitive member 10 and the contact transfer charger 16 directly contact with each other increases and the amount of charges imparted to the back of the transfer material becomes deficient, and for this reason, constant current control is not suitable for transfer materials of small sizes and therefore, in the present embodiment, the control of the present embodiment is effected when the longitudinal length of the transfer area in which the contact transfer charger 16 and the photosensitive member 10 contact with each other is defined as La and the length of that portion of said La which contacts with the transfer material is defined Lb and the relation that $$Lb/La>0.6$$

is satisfied.

Embodiment 3

Still another embodiment of the present invention is directed to effecting optimum control in conformity with the atmospheric environment of the image forming apparatus.

In the present embodiment, optimum control is effected in conformity with changes in humidity environment. The main construction of the apparatus is similar to that of Embodiment 2 with the exception that a humidity sensor, not shown, as humidity detecting means is added to the image forming apparatus of FIG. 4.

Figure 6:
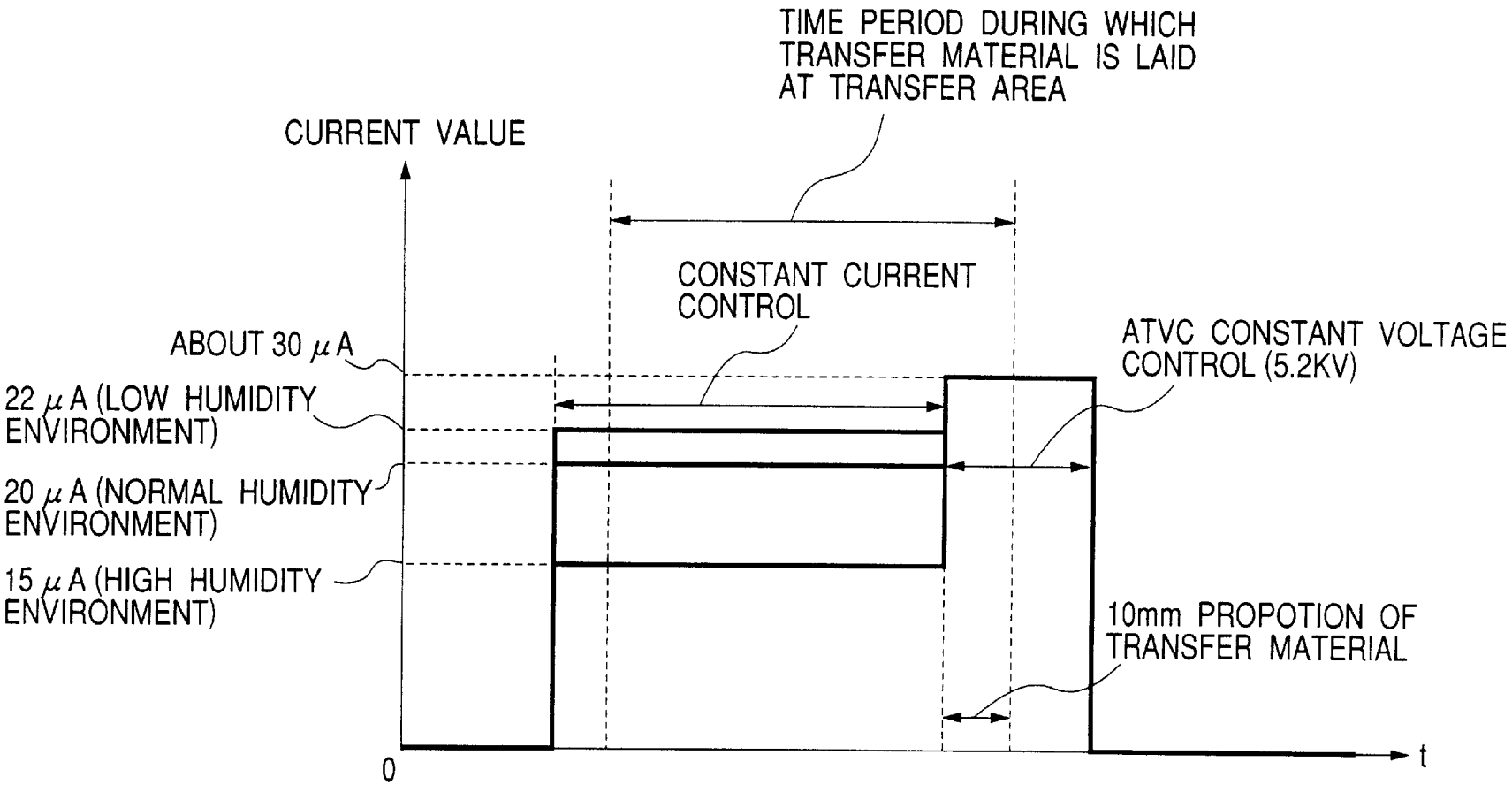
FIG. 6 shows the control of a transfer current in Embodiment 3 of the present invention.

FIG. 6 shows the control output value of a transfer current in the present embodiment.

In the present embodiment, relative humidity of less than 35% is defined as low humidity environment, relative humidity of 35% to less than 70% (35% or more and less than 70%) is defined as normal humidity environment, and relative humidity of 70% or higher is defined as high humidity environment, and the constant current values for these were 22 $\mu$A, 20 $\mu$A and 15 $\mu$A, respectively. The changeover from constant current control to constant voltage control was effected at a position of 10 mm from the trailing end portion toward the leading end with respect to the direction of conveyance of the transfer material 18.

It is known that the resistance value of the transfer material changes greatly depending on humidity environment. As is different depending on the quality of the transfer material, the resistance of a usually used transfer material under low humidity environment is $10^5$ to $10^6$ times as high as that under high humidity environment. So, if charges are imparted, for example, to all transfer materials of low resistance to high resistance under constant voltage control at the same voltage value, a greater current will flow through a transfer material of low resistance as a matter of course, and many charges will be imparted to the transfer material.

However, when an excessive amount of charges is imparted to the transfer material of low resistance, the charges go through the back of the transfer material to the photosensitive member 10, to thereby cause a sandy-soil-like charging memory or cancel the charges of the toner image on the photosensitive member and as the result, bad transfer (hereinafter referred to as the re-transfer) is caused.

On the other hand, it is considered that the above-noted problem will not arise if charges are imparted to all transfer materials lf low resistance to high resistance under constant voltage control at the same current value to thereby provide the same amount of charges per unit area, ut even if the same amount of charges are imparted, more charges go through the transfer material of low resistance to the photosensitive member 10 and therefore, it is preferable to make the amount of charges imparted to the transfer material If low resistance smaller.

So, in the present embodiment, the target constant current value during constant current control is set to a lower level for the transfer material of low resistance, whereby control conforming to the resistance of the transfer material changed by humidity environment is made possible.

As described above, by the target constant current value of constant current control being changed in conformity with humidity environment, good transfer can be done irrespective of humidity environment, but the target constant voltage value during constant voltage control may be changed in conformity with humidity environment.

While in the present embodiment, the relative humidity is detected and the substance of the control is changed over, of course this is not restrictive, but an absolute amount of moisture may be detected, or information such as the thickness, rigidity, size, quality, surface treatment or the substance of working of the transfer material may be obtained from detecting means or information inputting means or the like and in conformity with this information, the target value of the control output of constant current control or constant voltage control may be changed or the changeover position of the output value may be changed, whereby transfer materials of more kinds can be coped with.

While the image forming apparatus used in the present invention, in order to be comprehensibly illustrated, is of a construction in which the line linking the transfer area and the conveying surface of the conveying member 20 together is substantially horizontal, of course such a construction is not restricted, but the present invention can also be applied to an image forming apparatus of a construction in which the vicinity of the trailing end of a transfer material readily approach the charge eliminating needle 19*a*.

For example, the present invention is applicable if the acute angle D1 formed by a straight line linking that portion of the conveying member 20 which is nearest to the charge eliminating member 19*a* and supports the transfer material and the transfer area together and a horizontal line passing through the transfer area is between +40° and −20° (+ means a case where that portion of the conveying member 20 which is nearest to the charge eliminating member 19*a* and supports the transfer material is at a position higher than the horizontal line passing through the transfer area, and − means a case where said portion of the conveying member 20 is at a position lower than said horizontal line) and the conveying surface of the conveying member 20 at this time is upwardly or downwardly inclined in the direction of conveyance of the transfer material and the acute angle D2 formed by this surface with respect to the horizontal plane is 5° or less.

When this positional construction is applied to the image forming apparatus of the present invention, the position of that portion of the conveying member 20 supporting the transfer material which is nearest to the charge eliminating needle 19*a* is separate by about 3 cm from the transfer area and therefore, this means that the position of that portion of the conveying member 20 supporting the transfer material which is nearest to the charge eliminating needle 19*a* is between a position higher by about 2 cm than the height of the transfer area and a position lower by about 1 cm than the height of the transfer area.

Also, when D1 is between −20° and +20°, if D2 is 20° or less, the present invention can be applied, and particularly, when D1 is between −15° and +15° and D2 is 15° or less, the present invention is effective.

As described above, according to the present invention, the amount of charges per unit area imparted from a predetermined location on the image formable area of the transfer material to the trailing end side with respect to the direction of conveyance of the transfer material by the transfer means is greater than the amount of charges per unit area imparted from said predetermined location to the leading end side by the transfer means and therefore, the charges imparted to the back of the transfer material by the transfer means can be prevented from excessively flowing to the charge eliminating member to thereby make the back charges deficient and cause the toner to scatter.

While the embodiments of the present invention have been described above, the present invention is not restricted to these embodiments, but all modifications within the technical idea of the invention are possible.

What is claimed is:

1. An image forming apparatus comprising:

an image bearing member for bearing a toner image;

transfer means for electrostatically transferring the toner image on said image bearing member to a transfer material;

separating and charge eliminating means for charge-eliminating the transfer material to separate the transfer material from said image bearing member;

wherein said transfer means includes a transfer member forming a nip with said image bearing member and constant current control means for controlling a current to be applied on said transfer member to a predetermined value, and wherein said constant current control means effects control at a first current value from before a leading end of the transfer material reaches said nip, and switches to a second current value larger than the first current value in the vicinity of a trailing end of the transfer material in transferring operation.

2. An image forming apparatus comprising:

an image bearing member for bearing a toner image;

transfer means for electrostatically transferring the toner image on said image bearing member to a transfer material; and wherein said transfer means includes a transfer member forming a nip with said image bearing member, constant current control means for controlling a current to be applied on said transfer member to a predetermined value, constant voltage control means for controlling a voltage to be applied on said transfer member to a predetermined value, and switching means for switching said constant current control means and said constant voltage control means, wherein said switching means effects switching to said constant voltage control means in the vicinity of a trailing end of the transfer material in transferring operation, and wherein a current value applied on said transfer member by said constant voltage control means is larger than a current value applied on said transfer member by said constant current control means.

3. An image forming apparatus according to claim 2, further comprising humidity detecting means for detecting humidity, wherein said constant current control means changes a constant current value in accordance with a detection result of said humidity detecting means.

4. An image forming apparatus according to claim 2, further comprising humidity detecting means for detecting humidity, wherein said constant voltage control means changes a constant voltage value in accordance with a detection result of said humidity detecting means.

* * * * *

UNITED STATES PATENT AND TRADEMARK OFFICE

CERTIFICATE OF CORRECTION

PATENT NO. : 6,334,032 B1
DATED : December 25, 2001
INVENTOR(S) : Satoshi Tomiki It is certified that error appears in the above-identified patent and that said Letters Patent is hereby corrected as shown below:

Title page,
Item [57], ABSTRACT,
Line 3, "transfer" should read -- a transfer --;
Line 5, "separating" should read -- a separating --; and
Line 9, "constant" should read -- a constant --.

Drawings,
Sheet 2, FIG. 2, "PROPOTION" should read -- PROPORTION --;
Sheet 3, FIG. 3, "PRO" should read -- PRO- --; and
"POTION" should read -- PORTION --;
Sheet 5, FIG. 5, "PROPOTION" should read -- PROPORTION --; and
Sheet 6, FIG. 6, "PROPOTION" should read -- PROPORTION --.

Column 3,
Line 58, "cross-section of" should read -- cross-sectional --.

Column 4,
Line 35, "OV," should read -- 0V, --.

Column 5,
Line 13, "is" should be deleted; and
Line 40, "etc." should read -- etc., --.

Column 6,
Line 9, "at" should read -- at a --;
Line 17, "if" should read -- of --; and "t" should read -- to --.

Column 7,
Line 11, "A" should read -- As --; and
Line 32, "charges" should read -- charge --.

UNITED STATES PATENT AND TRADEMARK OFFICE

CERTIFICATE OF CORRECTION

PATENT NO. : 6,334,032 B1
DATED : December 25, 2001
INVENTOR(S) : Satoshi Tomiki It is certified that error appears in the above-identified patent and that said Letters Patent is hereby corrected as shown below:

Column 8,
Line 40, “If” should read -- of --;
Line 42, “ut” should read -- but --;
Line 43, “are” should read -- is --; and
Line 46, “If” should read -- of --.

Column 9,
Line 10, “restricted,” should read -- restrictive, --.

Column 10,
Line 9, “material;” should read -- material; and --;
Line 26, “image;” should read -- image; and --; and
Line 30, “; and” should read -- , --.

Signed and Sealed this

First Day of April, 2003

JAMES E. ROGAN
*Director of the United States Patent and Trademark Office*